US005993327A

United States Patent [19]

Terril

[11] Patent Number: 5,993,327

[45] Date of Patent: Nov. 30, 1999

[54] GOLF PUTTING DEVICE AND METHOD OF USING THE SAME TO PUTT A GOLF BALL

[75] Inventor: Terry Terril, 5406 Julia La., Land O'Lakes, Fla. 34639

[73] Assignees: Terry Terril; Thomas Terril, both of St. Louis, Mo.

[21] Appl. No.: 09/081,324

[22] Filed: May 19, 1998

[51] Int. Cl.[6] ..... A63B 53/14; A63B 53/16

[52] U.S. Cl. ..... 473/297; 473/300

[58] Field of Search ..... 473/300, 301, 473/302, 303, 304, 295, 297, 201, 202, 203, 204, 205, 549, 550, 551, 552, 553, 568, 559, 560, 298, 299, 293, 294; D21/756

[56] References Cited

U.S. PATENT DOCUMENTS

| | | |
|---|---|---|
| D. 319,278 | 8/1991 | Tosti . |
| D. 355,011 | 1/1995 | Subnick . |
| D. 377,070 | 12/1996 | Gurrola . |
| 740,500 | 10/1903 | White . |
| 1,210,182 | 12/1916 | Lynch . |
| 1,658,447 | 2/1928 | Lantz . |
| 1,696,462 | 12/1928 | Victor . |
| 2,051,083 | 8/1936 | Hart . |
| 3,075,768 | 1/1963 | Karns . |
| 3,219,348 | 11/1965 | Dishner, Jr. . |
| 3,459,426 | 8/1969 | Sherwood . |
| 3,856,603 | 12/1974 | Schaefer . |
| 4,067,573 | 1/1978 | Key, Jr. . |
| 4,179,125 | 12/1979 | Cone et al. . |
| 4,461,479 | 7/1984 | Mitchell . |
| 4,537,403 | 8/1985 | Farina . |
| 4,600,195 | 7/1986 | Hunter . |
| 4,690,407 | 9/1987 | Reisner . |
| 4,878,667 | 11/1989 | Tosti . |
| 4,988,102 | 1/1991 | Reisner . |
| 5,127,650 | 7/1992 | Schneller . |
| 5,169,152 | 12/1992 | Marquardt . |
| 5,364,102 | 11/1994 | Appledorn . |
| 5,398,930 | 3/1995 | Gibson . |
| 5,465,967 | 11/1995 | Boeckenhaupt . |
| 5,571,053 | 11/1996 | Lane . |

FOREIGN PATENT DOCUMENTS

| | | |
|---|---|---|
| 194823 | 3/1923 | United Kingdom . |

*Primary Examiner*—Sebastiano Passaniti
*Attorney, Agent, or Firm*—Stinson, Mag & Fizzell, P.C.

[57] ABSTRACT

A novel putting device is provided having a handle comprised of two relatively broad and flat surfaces for gripping the device, wherein the flat surfaces of the handle are positioned parallel to the striking surface of the device. A novel method of putting using the device is also claimed, wherein a golfer may grasp the handle by pressing the flattened palms of his or her hands against the flat surfaces and swing the device ("putt") by simply moving his or her wrists back and forth, such that the device swings like a pendulum. In an alternative embodiment, a weight assembly may optionally be added to the upper handle end of the putting device to shift the weight center and adjust the overall "feel" of the device to meet the individual golfer's needs.

26 Claims, 5 Drawing Sheets

GOLF PUTTING DEVICE AND METHOD OF USING THE SAME TO PUTT A GOLF BALL

BACKGROUND OF THE INVENTION

1. Field of the Invention

The present invention is generally directed to the field of sports and sporting equipment, and is more particularly directed to a novel golf putting device and method of using the same for putting golf balls, wherein the putting device and related method provide the golfer a high degree of control over his or her putting stroke.

2. Description of the Related Art

The game of golf is an extremely popular sport in the United States and in many other countries throughout the world. A variety of different types of golf clubs are needed in the game to hit the golf ball toward and into the designated hole. For example, a conventional set of golf clubs will include wood or metal drivers for hitting the ball from the tee, a set of irons for hitting the ball from the fairway, and a putter for hitting the ball on the green and into the hole. Various configurations and materials have been developed over the years for golf clubs, and those in the art continue to strive to develop new golf club designs and materials that will enhance the golfer's game. In developing these new designs and materials, the rules of professional golf governed by the United States Golf Association (USGA) are taken into consideration in an effort to provide clubs that are not only more effective for purposes of playing the game, but also conform with specifications established by the USGA.

Of particular import to the present invention is the continuing development of putters that enable the golfer to putt the ball more accurately. One of the most difficult aspects of the game of golf is putting the ball. Extreme accuracy is required in determining the line on which the ball should roll, determining the speed at which the ball should roll, and striking the ball squarely with the striking surface of the putter so that the ball rolls along the adjudged line and at the proper speed.

The traditional putting stroke requires the golfer to move his or her upper body, arms, and hands and teaches against a breaking of the wrists. In the traditional putting method, using a conventional putter design, the golfer must control the muscles of the entire upper body, providing many opportunities for error in the swing. These errors in swinging are often referred to as "pushing" or "pulling" a putt. Although persons in the art have refined the traditional putting stroke, few, if any, attempts have been made to modify the basic method of putting.

Conventional putters used in conjunction with the traditional putting swing include a putter head having a striking surface for hitting the ball, an elongated shaft, and a generally cylindrical handle. The golfer wraps his or her palms around the cylindrical handle locking his or her fingers so that one hand is positioned above the other. While conventional putters have proven useful for putting, those in the art are continuously seeking to improve putting devices to increase the accuracy and reproducibility of the golfer's putt. For example, a variety of putter head configurations and materials have been developed to assist a golfer to obtain a more accurate or more controlled putting stroke.

It is also known to provide weights in the head or handle of the putter to move the weight center of the putter closer to the point at which the golfer grasps the device. In the conventional golf putter and method of putting, a major portion of the putter's weight is in the head of the device, such that the weight center of the putter is located nearer to the head than to the handle of the device. When a golfer grasps the handle of a conventional putter, the golfer's hands are some distance from the weight center of the putter, making it difficult for some golfers to control the putter. Grasping the putter nearer the weight center may increase the golfer's control of the device, thereby increasing the accuracy of the golf swing.

Various attempts have been made to move the weight center of a putter by designing a golf putter with increased weight toward the handle end, and a number of weighted golf putters are known in the art. For example, it is known in the art to add a weighted grip or a detachable weight to the putter handle. Because these single-unit weight assemblies must either be attached or removed in their entirety, such weight assemblies do not allow a golfer to fine tune the handle weight to the specific weight that is optimal for that particular golfer.

Similarly, in other known golf putter weight assemblies, one or more of the weights is permanently affixed to or embedded within the shaft. After the weight is affixed or inserted, it becomes difficult or impossible to remove the weight without the assistance of a golf professional, such that the golfer cannot easily alter the weights during a round of golf. Furthermore, embedded weights are not visible by simply looking at the putter, which forces a golfer to remove the weight assembly to determine how many weights, if any, were added during the last use of the putter. Finally, only putters constructed so that the weights may be inserted into the handle may be used with such weight assemblies.

It is also known to provide a weight assembly that may only be added or adjusted by removing and adding new gripping tape. This "regripping" process is complex and time-consuming so as to deter changing the weight while on the golf course. In some devices the regripping process is so involved that the golfer must seek the assistance of a golf professional to make any weight adjustments.

Although these prior methods and devices known for putting golf balls are suitable for such purposes, a need remains in the art for an improved method of putting and/or putting device that increases the golfer's control over the swing resulting in improved accuracy and reproducibility of the swing. To this end, one of the primary objects of the invention is to provide a putting device and method of putting that enable the golfer to consistently hit the ball squarely by eliminating many of the variables involved in putting.

Another object of the invention is to provide a putting device and method of putting that allow the golfer to more effectively control his or her swing and avoid "pushing" or "pulling" the putt.

Another object of the invention is to provide a putting device and method of putting that allow a golfer to grip the device in a natural and relaxed stance by comfortably grasping the device.

A further object of the invention is to provide a method of putting that uses primarily a motion of the wrists, thus reducing the number of muscles needed for the putt and, as a result, reducing the chances for error.

A further object of the invention is to provide a golf putting device that a golfer may accurately swing using only a motion of the wrists.

Yet another object of the invention is to provide a weight assembly for a putting device that allows a golfer to vary the weight of the device quickly and conveniently on the golf course without changing the grip of the device.

A further object of the invention is to provide a weight assembly for a putting device that does not extend into the interior of the handle so that the assembly may be used in conjunction with any shape of putter handle.

Another object of the invention is to provide a weight assembly for a putting device that allows the golfer to use a combination of weights such that the weight center of the putting device corresponds to the point at which the golfer grasps the device.

Yet another object of the invention is to provide a putting device that meets the foregoing objectives and also fulfills the requirements set forth by the USGA.

SUMMARY OF THE INVENTION

These and other objects of the present invention are achieved by a novel putting device having a handle comprised of two relatively broad and flat surfaces for gripping the device wherein these flat surfaces of the handle are positioned parallel to the striking surface of the device. A golfer may grasp the handle by pressing the flattened palms of his or her hands against the flat surfaces and swing the device ("putt") by simply moving his or her wrists back and forth, such that the device swings like a pendulum. Optionally, a weight assembly may be added to the upper handle end of the putting device to shift the weight center and adjust the overall "feel" of the device to meet the individual golfer's needs.

In a preferred embodiment of the invention, the putting device comprises a head with a striking surface for hitting the ball, an elongated shaft extending upwardly from the head, and a handle secured along the upper end of the shaft. The handle comprises a central flat fork-shaped member sandwiched between two externally flat gripping plates, wherein the exterior surfaces of the gripping plates extend in planes parallel to the striking surface of the head. The fork-shaped member has an upper base and elongated tines extending downwardly from opposite sides of the lower edge of the base, such that the tines define an elongated opening or channel for receiving an upper portion of the shaft. A slot provided along the upper end of the shaft is configured to fit over and matingly receive the central lower edge of the base so that the base and shaft are securely fitted together. The slot is preferably integrally formed within the upper end of the shaft or alternatively provided via an adapter secured within or to the upper end of the shaft. To comply with USGA regulations mandating that the shaft extend the entire length of the handle, the slot formed in the upper end of the shaft fits over the entire length of the base so as to extend to the top edge of the fork-shaped member.

In a related embodiment of the invention, one or more weights may be added to the upper handle end of the putting device to shift the weight center and adjust the overall "feel" of the device to meet the individual golfer's needs. The weight assembly is attached to the outer surface of the upper handle end with a connector that extends through the center of the weights and into the upper handle end. The connector is the only portion of the weight assembly that extends into the handle of the device. Preferably, the cross-section of the weight assembly conforms in shape to a cross-section of the handle, such that the outer periphery of the weights is flush with the outer periphery of the handle. In a weight assembly consistent with the present invention, the weights are removable, and may be easily adjusted on the golf course by the golfer. Alternatively, the weights may be irremovably attached to the handle to comply with the rules of the USGA.

The putting device of the present invention may be utilized in a novel method of putting in which the golfer swings the putting device using primarily a motion of the wrists. To perform a golf swing using the putting device of the present invention, the golfer comfortably grasps the flat handle of the putting device between the palms of his or her outstretched hands with palms directly opposite one another against the flat surfaces. The golfer steadies the device with the palms of both hands and swings the device like a pendulum using primarily a motion of the wrists while holding the remainder of the body motionless.

This method of putting utilizes fewer muscles than the traditional putting swing, thereby limiting the opportunities for error and providing the golfer with increased control over his or her putt. Of particular importance, it is believed that putter path and face angle mistakes may be significantly minimized by using this wrist actuated method of putting. Furthermore, insofar as this method of putting positions the golfer in a natural and relaxed putting stance, it is believed that the limited number of muscles used in the swing are relaxed. A swing that uses a limited number of muscles in a relaxed position will decrease the chances of a "pushed" or "pulled" putt, such that this novel method increases the accuracy and reproducibility of a putt.

While the drawings and above description are directed to golf putting devices for illustrative purposes, it is understood that the device and method of the present invention may be adapted for use with other sporting devices for hitting objects, such as non-putter golf clubs, hockey sticks, polo sticks, and the like.

DESCRIPTION OF THE PREFERRED EMBODIMENTS

Figure 1:
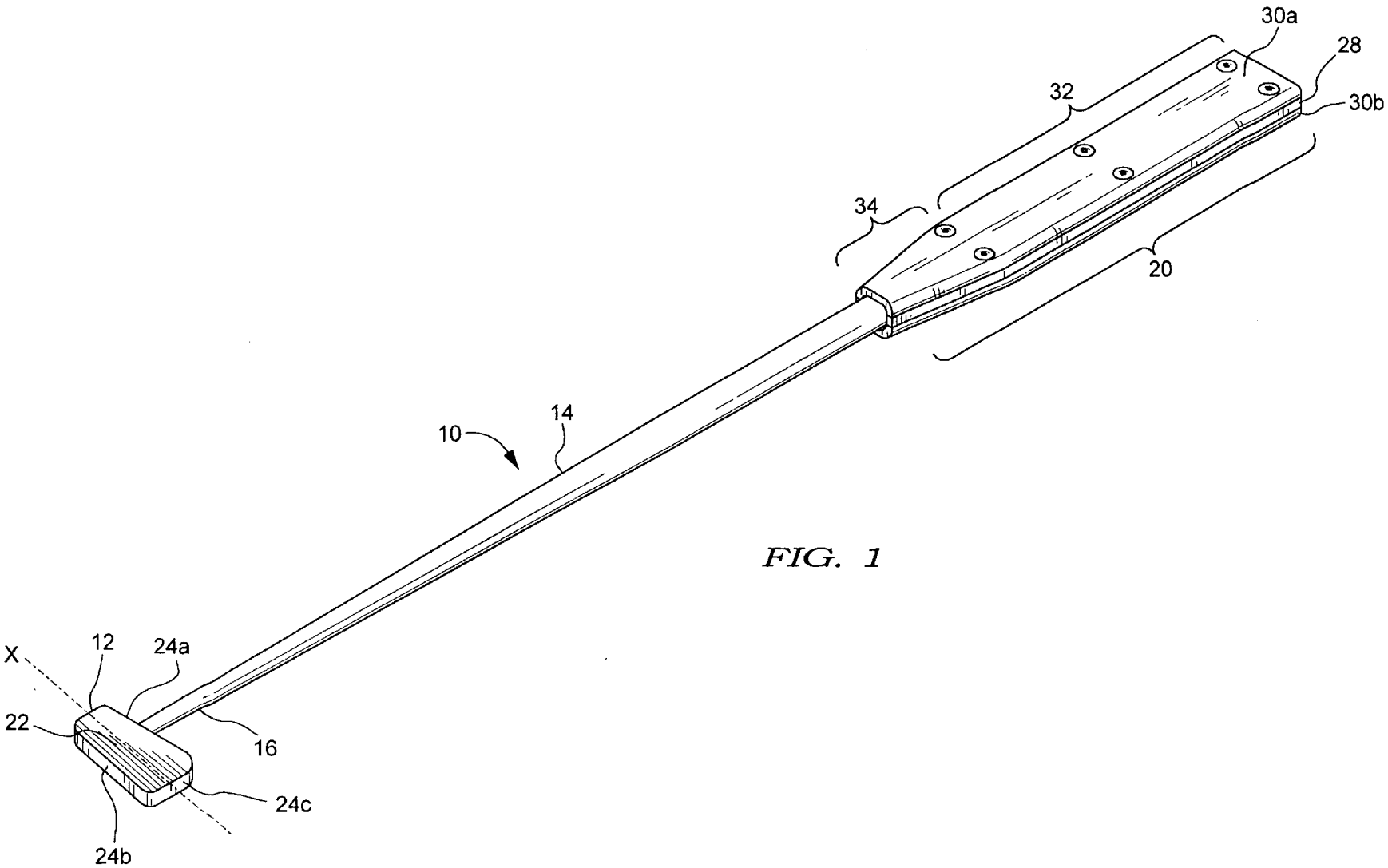
FIG. 1 is a perspective view of an assembled putting device in accordance with a first embodiment of the present invention.
Figures 2, 3:
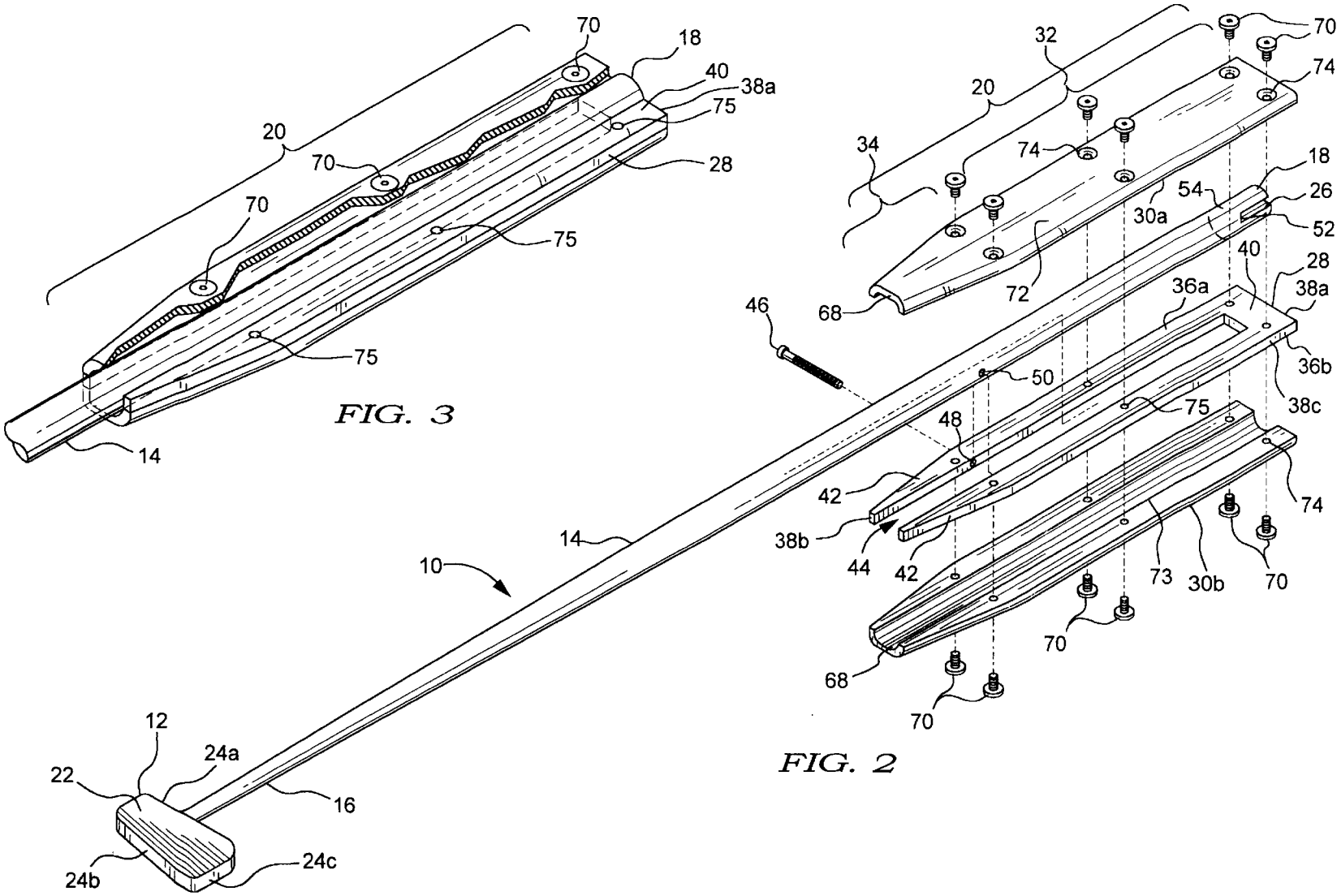
FIG. 2 is an exploded perspective view of the putting device of FIG. 1.
FIG. 3 is a partial cutaway view of the assembled putting device of FIG. 1.

Looking to FIGS. 1 and 2, a putting device or putter in accordance with a first embodiment of the present invention is designated generally by the numeral 10. Putter 10 comprises a putter head 12, an elongated hollow shaft 14 extending upwardly along a longitudinal axis of the putter from a lower end 16 to an upper end 18, and a relatively broad flat handle 20 wherein an upper portion of shaft 14 is received within handle 20.

Head 12 comprises a generally rectangular conventional golf putter head having a relatively flat front striking surface 22 for hitting a ball, a rear surface (not shown) and peripheral top, bottom and side edges 24*a*, 24*b*, and 24*c* respectively. Lower end 16 of shaft 14 is secured to head 12 along its top peripheral edge 24*a* such that striking surface 22 lies in a plane x relative to the putter. The head 12 may be secured to lower end 16 of shaft 14 by any means now known or later developed in the art including through the use of adhesives such as heat-activated epoxy glue, or by a conventional screw attachment wherein lower end 16 is threaded and screwed into head 12.

Head 12 may be formed of any rigid material known in the art including wood; metallic materials such as iron ore, titanium or aluminum alloy; and/or plastic composite materials. It should be understood that while the drawings depict a relatively flat and rectangular putter head, a variety of different putter head configurations are known in the art and are considered suitable for purposes of this invention. For example, many putters currently available in the marketplace include an enlarged front striking surface and a weighted member extending from the rear surface of the putter head. While it is believed that lighter weight and/or unweighted putter heads may be easier to control for purposes of the present method of putting, the weighted putter head configurations may also be used without departing from the invention.

Furthermore, it should be understood that the invention is not limited to golf putters but may also be applied to other types of golf clubs or to other types of sporting devices used for hitting objects. In those other devices, head 12 comprises the hitting member of the device such as the club head of a pitching wedge, the hitting blade of a hockey stick, or the barrel end of a croquet stick. The important feature of head 12 for purposes of this invention is that the head is secured to the lower end of shaft 14 and includes some form of striking surface lying within a plane x relative to the device.

Shaft 14 comprises a conventional elongated hollow cylindrical golf putter shaft made of any resilient material known in the art including aluminum alloy and/or graphite. As shown in FIG. 2, a slot 26 is formed in the upper end of the shaft and is configured to matingly receive a portion of the handle as hereafter described so as to securely stabilize the upper end of shaft 14 within handle 20.

Looking to FIG. 2, handle 20 comprises central fork-shaped member 28 configured to matingly receive an upper portion of shaft 14, and two externally flat gripping plates 30*a* and 30*b*, wherein fork-shaped member 28 and an upper portion of shaft 14 are sandwiched between gripping plates 30 when the putter is assembled. The fork-shaped member 28 and gripping plates 30 correspond in outer shape such that when the putter is assembled the peripheral edges of the fork-shaped member and gripping plates are flush. The exterior flat surfaces of the handle formed by gripping plates 30 include an upper generally rectangular gripping section 32 and a lower tapered section 34 which tapers inward toward shaft 14 so as to provide a smooth transition in the shape of the putter from the relatively broad gripping section of the handle to the more narrow shaft.

While various dimensions of the handle are considered suitable for purposes of this invention, in a preferred embodiment the transverse width of the exterior flat surfaces is greater than the diameter of the shaft and preferably ranges from one (1) inch to two and a half (2½) inches wide, and is most preferably about one and three-fourths (1¾) inches wide. The overall longitudinal length of the exterior flat surfaces ranges from 11 to 15 inches and is most preferably about 13 inches long. The longitudinal length of the gripping section 32 ranges from nine (9) to eleven (11) inches and is preferably about ten (10) inches in length. The thickness of handle 20 as measured perpendicular the flat surfaces to include the combined side edges of the gripping plates and fork-shaped member is relatively thin ranging from three-fourths (¾) to one and one-fourth (¼) inches in thickness and preferably being about seven-eighths (⅞) inch thick.

Still looking to FIG. 2, fork-shaped member 28 is relatively flat having front and rear faces 36*a* and 36*b*, and top, bottom and side peripheral edges 38*a*, 38*b*, and 38*c* respectively. Fork-shaped member 28 includes an upper base 40 and at least two tines 42 extending downwardly from opposite sides of the lower edge of base 40 along the longitudinal axis of the putter. Tines 42 define a central opening 44 that is closed at its upper end by the central lower edge of base 40. Central opening 44 is configured to receive shaft 14 such that tines 42 extend downwardly in abutting engagement with an upper portion of shaft 14 and the lower edge of base 40 is fitted into slot 26. Shaft 14 may be further secured to fork-shaped member 28 by shaft screw 46 extending transversely through tines 42 and shaft 14 via screw holes 48 and 50 respectively.

Fork-shaped member 28 is preferably made of a relatively thin and light weight material and is most preferably made of aluminum.

Figure 4:
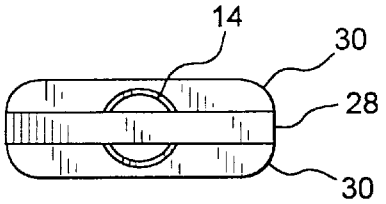
FIG. 4 is a top end view of the putting device of FIG. 1.

Slot 26 is preferably integrally formed within shaft 14 such that upper end 18 of shaft 14 includes notches 52 for receiving the lower edge of base 40. In this first embodiment of the invention, the length of notches 52 corresponds to the length of base 40. As can be seen in FIGS. 3 and 4, when base 40 of fork-shaped member 28 is received within notches 52, upper end 18 of shaft 14 extends upwardly across the entire length of base 40 to top edge 38*a* of fork-shaped member 28. This embodiment conforms to the rules of the USGA, which have been interpreted to require that the shaft must extend to the upper end of the grip. In this embodiment, shaft 14 extends to top edge 38*a* of fork-shaped member 28. The base preferably ranges in length from one-half (½) inch to about three (3) inches and is most preferably about one (1) inch long. The length or depth of slot 26 corresponds with the length of base 40 so as to receive the entire length of the base.

Figure 5:
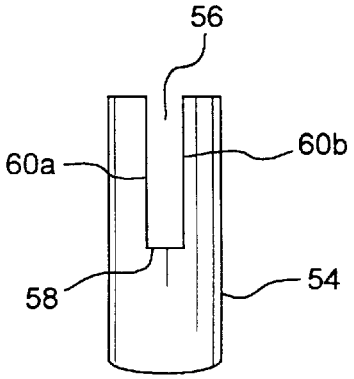
FIG. 5 is a perspective view of an insert in accordance with the present invention.

Looking to FIGS. 2 and 5, in a preferred embodiment of this invention a cylindrical insert 54 is secured within the hollow upper end 18 of shaft 14 to reinforce the shaft. Insert 54 comprises a cylindrical tube with a closed top wherein the outer diameter of insert 54 is slightly less than the inside diameter of hollow shaft 14 such that insert 54 can be press fitted into, or otherwise secured within, upper end 18 of shaft 14. Insert slit 56 formed across the closed top of insert 54 is defined by a bottom slit floor 58 and two opposing slit sidewalls 60*a* and 60*b* integrally formed within the closed top. Insert slit 56 is configured to correspond in shape and size to notches 52 such that insert 54 strengthens the upper end of shaft 14 and combines with notches 52 in the shaft to define slot 26. Insert 54 may be formed of any rigid material and is preferably formed of a metal, such as steel or aluminum.

Figures 6, 7:
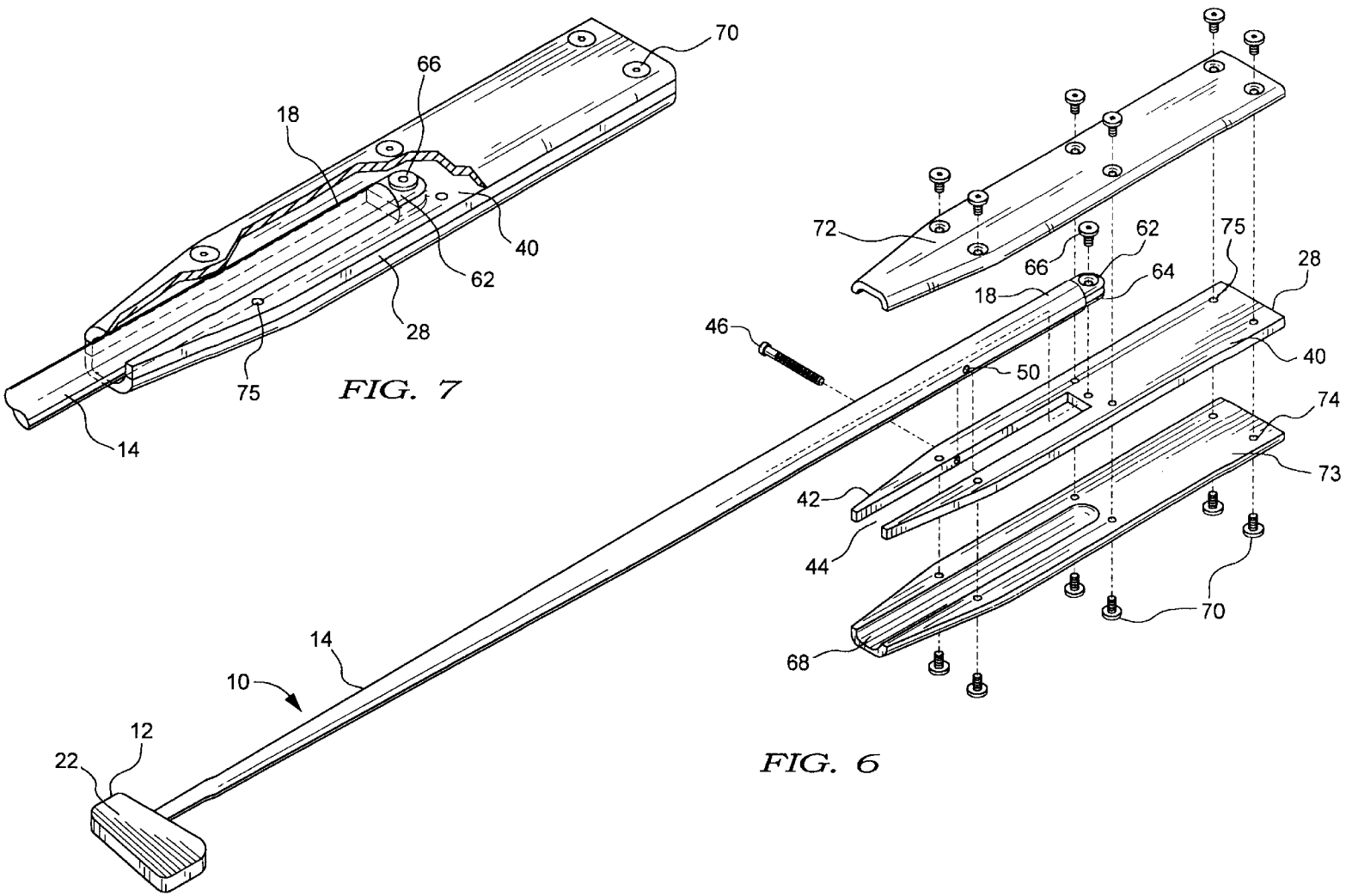
FIG. 6 is an exploded perspective view of a putting device in accordance with an alternative embodiment of the present invention in which an adaptor is secured to the upper end of the shaft.
FIG. 7 is a partial cutaway view of the assembled putting device of FIG. 6.

FIGS. 6 and 7 depict an alternative embodiment of the invention wherein upper end 18 of shaft 14 does not include notches and an adaptor 62 is secured to the upper end of shaft 14 to extend beyond the upper end. Adaptor 62 may be secured to the upper end of shaft 14 by any means known in the art, including by pressure fitting adaptor 62 into upper end 18 or by affixing adaptor 62 to upper end 18 with epoxy glue. Adaptor 62 comprises a round cylinder having a closed top with an adaptor slot 64 integrally formed within the closed top to matingly receive and fit over the lower edge of base 40. In this embodiment, adaptor slot 64 does not extend the entire length of base 40, but is merely used to assist in firmly securing and stabilizing shaft 14 within fork-shaped member 28. In this embodiment, the overall length of base 40 preferably ranges from one (1) to seven (7) inches in length and is most preferably about six (6) inches long. An adaptor screw 66 may additionally be used to secure adaptor 62 to fork-shaped member 28. Although adaptor 62 may have any shape that assists stabilization of shaft 14, adaptor 62 is preferably at least three (3) inches long, and most preferably six (6) inches long, with a slot of depth ranging from one-fourth (¼) to one (1) inch long. Adaptor 62 may be formed of any rigid material and is preferably formed of a metallic material such as steel, iron or aluminum, plastic, and/or composite materials.

Returning to FIGS. 2 through 4, front and rear gripping plates 30*a* and 30*b*, respectively, have a relatively broad flat exterior surface 72 and an internal surface 73 configured to abuttingly engage the respective faces of fork-shaped member 28 and an upper portion of shaft 14 received therein. Internal surface 73 of each gripping plate includes an internal groove 68 that conforms in shape to the exterior surface of shaft 14, such that a portion of the shaft is cradled within groove 68 and gripping plates 30 fit snugly against shaft 14 and fork-shaped member 28. This configuration adds to the stability of putter 10 by preventing movement of shaft 14 and fork-shaped member 28 within the handle when the putter is in use. Gripping plates 30 may be secured to fork-shaped member 28 by any means known in the art, including by epoxy glue or handle screws 70, preferably by six (6) handle screws 70 extending through each flat gripping plate 30 and into the respective faces of fork-shaped member 28 via screw holes 74 and 75 respectively.

Gripping plates 30 are preferably solid in nature and formed of a material suitable for gripping such as wood, metal, plastic and/or composite materials. The gripping plates may be customized by the golfer, for example by engraving the golfer's name into the exterior surface 72 of gripping plate 30. Gripping plates 30 preferably include rounded or beveled side edges for increased comfort for the golfer.

It should be understood that while the preferred embodiments depicted in the drawings include two gripping plates, other external handle surfaces may be used without departing from the present invention. For example, the two gripping plates as described may be replaced instead by a single sleeve grip (not shown) surrounding fork-shaped member 28 or by more than two gripping pieces (not shown) that combine to cover fork-shaped member 28. The key purpose of the gripping plates is to provide relatively broad and flat external gripping surfaces that extend in a plane parallel plane x in which the striking surface of the putter lies such that the user can position his or her palms flat against the surfaces and swing the putter by motion of the wrists consistent with the method of the present invention.

Figure 8:
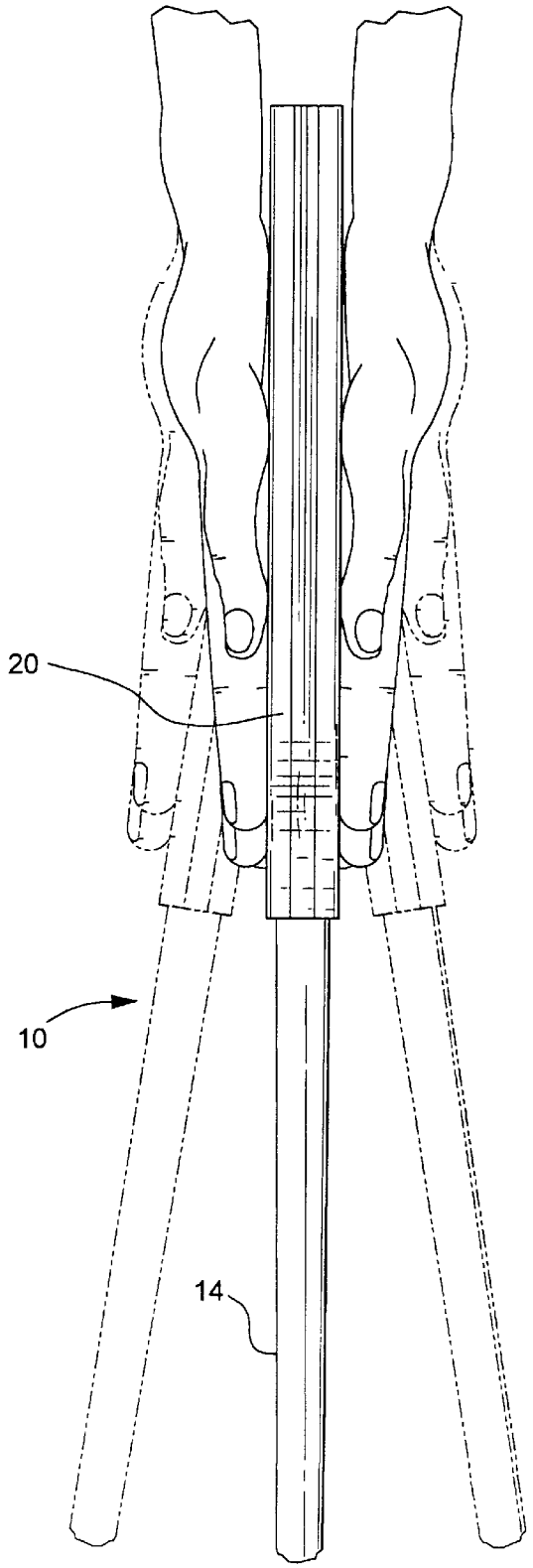
FIG. 8 is a perspective view of a putting device in accordance with the present invention shown in association with the hands of a user in accordance with the putting method of the present invention.

Looking to FIG. 8, putter 10 may be used in a novel method of putting wherein the user grasps handle 20 of putter 10 between outstretched palms of his or her hands, placing a flattened palm on each side of the flat handle 20 in a manner resembling praying hands. To putt, the golfer primarily moves his or her wrists, holding his or her shoulders and arms generally stationary, thereby limiting the number of muscles that must interact to perform the swing. Limiting the number of muscles limits the opportunities for error and provides the golfer with more control over the swing.

Figure 9:
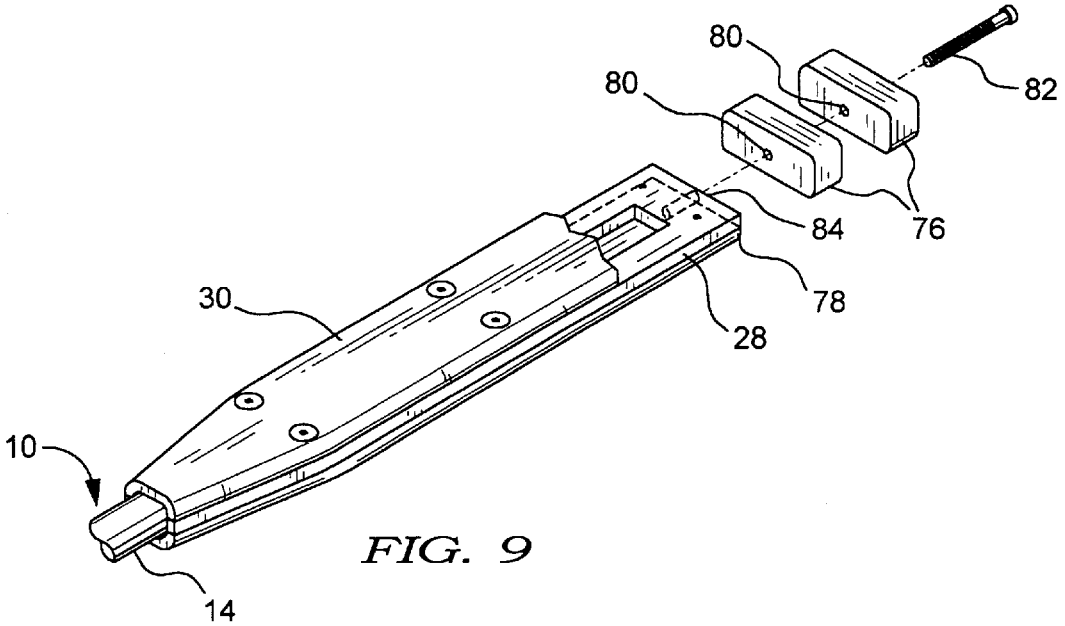
FIG. 9 is a partial cutaway view of the assembled putter of FIG. 1 wherein a weight assembly is added to the putter in accordance with a second embodiment of the present invention.

In a second embodiment of the present invention shown in FIG. 9, putter 10 includes one or more removable weights 76 attached to the outer surface of upper handle end 78 of the putter. The cross-section of each removable weight 76 preferably conforms to the cross section of the surface of upper handle end 78 such that the edges of weights 76 are flush with the edges of the handle to produce an aesthetically pleasing appearance.

A weight assembly in accordance with the present invention enables a golfer to conveniently and selectively adjust the amount of weight at the handle end of the device. Weights 76 attach to the outer surface of upper handle end 78, with no portion of weights 76 extending into the interior of the handle. Because no portion of weights 76 extend into the handle, the weight assembly is compatible with almost any golf putter construction.

In the weight assembly of the present invention, the addition and removal of weights is uncomplicated and does not require the removing and replacing of any gripping material that may surround the handle of the device. In a preferred embodiment, weights 76 include a hole 80 extending longitudinally through the center thereof Removable weights 76 are attached to the outer surface of upper handle end 78 by weight screw 82 which passes through weights 76 and threads into an threaded opening 84 through the top edge of fork-shaped member 28. The user may easily add weights 76 by running weight screw 82 through hole 80 and threading the exposed end of screw 82 into opening 84. The user removes weights 76 by reversing the process. The ease in adjusting the weight of the handle end allows the golfer to experiment to find the weight that is most suited for his or her grip, swing and stance while on the golf course. In most cases, the optimum weight is the weight that places the putter's weight center in close proximity to the spot at which the golfer grasps the putter.

Any number of weights can be selectively secured to upper handle end 78 to shift the weight center of the putter closer to the point at which the golfer holds the putter, thereby increasing the golfer's control over the swing and, as a result, improving the accuracy and reproducibility of the swing. Adding weight to upper handle end 78 of putter 10 further increases the force of the swing, enabling the golfer to putt the golf ball a greater distance using only a small movement of the wrists. The weights may be constructed as multiple one (1) ounce weights, such that the golfer varies the amount of weight by adding or removing one or more weights. Alternatively, the weights may be constructed of incrementally increasing weight amounts, i.e. a one (1) ounce weight, a two (2) ounce weight and a three (3) ounce weight, such that a single weight is secured to the upper handle end of the putter and the weights may be interchanged to fit the needs of the individual golfer.

Weights 76 may be constructed of metallic materials such as steel, brass and copper or any other suitable weighted material known in the art and may be constructed in a variety of shapes to correspond to a variety of handle shapes.

In a further embodiment of the invention, to comply with USGA regulations the weight assembly is constructed so that weights 76 cannot be removed while the player is on the golf course. In this embodiment, weights 76 are irremovably affixed to the outer surface of upper handle end 78, such as with a fastener (not shown) or with epoxy glue. The entire handle assembly, comprising the irremovable weights, the fork-shaped member, and the gripping plates, is fitted onto the upper end of shaft 14 and attached to the shaft by shaft screw 46. The handle assembly may contain any amount of weight, and handle assemblies of different weights may be interchanged between rounds of golf This embodiment has been approved by the USGA.

It should be understood that while the adjustable weight assembly has been described and shown in conjunction with the flat handled putting device of the first embodiment of this invention, the weight assembly may optionally be used with other conventional-shaped rounded handle putters as well.

The preferred embodiments directed to golf putters described above are illustrative only. Numerous changes, modifications and alterations will be contemplated by those skilled in the art without departing from the spirit and scope of the novel concept of this invention. The scope of the invention is limited only by the appended claims and any modifications within the scope of the claims.

I claim:

1. A putting device for putting a golf ball comprising:

a head having a generally flat striking surface;

a shaft having a lower end attached to said head and extending upwardly along a longitudinal axis of the device from said head to an upper end;

a handle comprising a flat fork-shaped member having front and rear faces and at least two gripping plates, wherein said fork-shaped member comprises a base and at least two tines extending downwardly from a lower edge of said base along a longitudinal axis of the device, said tines defining an opening into which the upper end of said shaft is received, and wherein said gripping plates are affixed to the front and rear faces respectively of said fork-shaped member such that the upper end of the shaft and the fork-shaped member are sandwiched between said gripping plates.

2. The putting device of claim 1, wherein each of said gripping plates has a generally flat external surface and an internal surface.

3. The putting device of claim 2, wherein said external surface of each said gripping plate is in a plane parallel to said striking surface.

4. The putting device of claim 3, wherein said device further comprises a plurality of handle screws for connecting said gripping plates to said fork-shaped member.

5. The putting device of claim 3, wherein said device further comprises a shaft screw, said shaft screw connecting said tines to said shaft.

6. The putting device of claim 3, wherein said device further comprises one or more weights affixed to an outer surface of an upper end of said handle.

7. The putting device of claim 6, wherein a cross-section of said weights conforms in shape to a cross section of said handle.

8. The putting device of claim 7, wherein said device further comprises a means for attaching said weights to said handle.

9. The putting device of claim 8, wherein said weights are irremovable and said means for attaching is a fastener extending through a center of said weights and into a top edge of said fork-shaped member.

10. The putting device of claim 9, wherein said device further comprises a shaft screw, said shaft screw connecting said tines to said shaft.

11. The putting device of claim 8, wherein said weights are removable and said attaching means is a screw extending through a center of said weights and into a top edge of said fork-shaped member.

12. The putting device of claim 11, wherein said device further comprises a shaft screw, said shaft screw connecting said tines to said shaft.

13. The putting device of claim 3, wherein a slot for receiving said lower edge of the base of the fork-shaped member is provided along the upper end of said shaft.

14. The putting device of claim 13, wherein said slot is formed integral with said shaft.

15. The putting device of claim 14, wherein said shaft is hollow and said slot is defined by at least one notch in the upper end of said shaft.

16. The putting device of claim 15, wherein said upper end of said shaft extends to a top edge of said fork-shaped member when said fork-shaped member is received within said slot such that said upper end is flush with said top edge.

17. The putting device of claim 16, wherein said device further comprises an insert received within said upper end of the hollow shaft, wherein said insert does not extend beyond the upper end of said shaft and wherein said insert has a closed top which defines a slit corresponding in size and shape to said notches in the shaft.

18. The putting device of claim 17, wherein said device further comprises a shaft screw, said shaft screw connecting said tines to said shaft.

19. The putting device of claim 18, wherein said device further comprises one or more weights affixed to an outer surface of an upper end of said handle.

20. The putting device of claim 13, wherein said shaft is hollow.

21. The putting device of claim 20, wherein said device further comprises an adaptor, wherein said adaptor is received within said hollow shaft and extends beyond the upper end of said shaft, and wherein said slot is defined by said adaptor.

22. The putting device of claim 21, wherein said device further comprises a shaft screw, said shaft screw connecting said tines to said shaft.

23. The putting device of claim 22, wherein said device further comprises one or more weights affixed to an outer surface of an upper end of said handle.

24. A golf device comprising:

a head having a generally flat striking surface for hitting a golf ball;

a shaft attached to the head, said shaft having a lower end extending upwardly along a longitudinal axis from said head to an upper end, wherein said upper end of the shaft defines a slot; and a generally flat handle comprising a flat fork-shaped member and at least two externally flat gripping surfaces wherein said fork-shaped member has a base and at least two tines extending downwardly from a lower edge of said base along the longitudinal axis of the device, said tines defining an opening into which said upper end of the shaft is received, and said lower edge of the fork-shaped member being received within said slot in the shaft, and wherein said gripping surfaces are secured over said fork-shaped member externally in planes parallel to a plane containing said striking surface.

25. The golf device of claim 24, wherein said device further comprises:

one or more weights conforming in shape to a cross-section of said handle;

a connector extending through a center of each said weight, wherein said connector attaches said weights to an upper end of said handle.

26. The golf device of claim 25 wherein said weights are removable.

* * * * *

UNITED STATES PATENT AND TRADEMARK OFFICE

CERTIFICATE OF CORRECTION

PATENT NO : 5,993,327

DATED : November 30, 1999

INVENTOR(S) : Terry Terril

It is certified that error appears in the above-identified patent and that said Letters Patent is hereby corrected as shown below:

In column 5, line 59, of the Patent, change "($\frac{1}{4}$)" to -- ($1\frac{1}{4}$) --.

In column 8, line 3, of the Patent, change "thereof Removable" to -- thereof. Removable --.

In column 8, line 46, of the Patent, change "golf This" to -- golf. This --.

Signed and Sealed this

Fourth Day of July, 2000

*Attest:*

*Attesting Officer*

Q. TODD DICKINSON

*Director of Patents and Trademarks*